US005421227A

United States Patent [19]

Röhrdanz et al.

[11] Patent Number: 5,421,227

[45] Date of Patent: Jun. 6, 1995

[54] METHOD OF SUBDIVIDING WEBS

[75] Inventors: Albrecht Röhrdanz, Dresden; Jens Naecker, Hamburg, both of Germany

[73] Assignee: alfill Getränketechnik GmbH, Hamburg, Germany

[21] Appl. No.: 48,739

[22] Filed: Apr. 16, 1993

[30] Foreign Application Priority Data

Apr. 18, 1992 [DE] Germany ..... 4212987

[51] Int. Cl.[6] ..... B26D 1/62

[52] U.S. Cl. ..... 83/38; 83/26; 83/42; 83/263; 83/313; 83/403.1; 83/416; 83/650

[58] Field of Search ..... 83/13, 37, 38, 42, 72, 83/263, 312, 403.1, 650, 313, 367, 416, 26; 242/56 R

[56] References Cited

U.S. PATENT DOCUMENTS 3,639,055 2/1972 Schleifenbaum ..... 83/38 X
4,020,722 5/1977 Byrt et al. ..... 83/403.1 X

FOREIGN PATENT DOCUMENTS 0223405 5/1987 European Pat. Off. .
0183336 6/1990 European Pat. Off. .
1075932 2/1960 Germany .
1208871 1/1966 Germany .
1233686 8/1967 Germany .
2435441 2/1975 Germany .
2917582 10/1980 Germany .
3114470 2/1982 Germany .
3418221 11/1984 Germany .
3840231 10/1989 Germany .
4122411 1/1992 Germany .
4113747 11/1992 Germany .

*Primary Examiner*—Richard K. Seidel
*Assistant Examiner*—Raymond D. Woods
*Attorney, Agent, or Firm*—Darby & Darby

[57] ABSTRACT

A web of coherent labels or coherent blanks of wrapping material is advanced along an elongated path toward a severing station where the web is cut at selected intervals by an orbiting knife in cooperation with a stationary or moving knife to yield a succession of sections of desired length. If the web is to be arrested for a shorter or longer period, it is first accelerated above its standard speed and is thereupon decelerated to zero speed during the last interval of advancement so that the length of the leader of the web extending beyond the severing station matches the desired length. Analogously, when the web is restarted, it is accelerated above the standard speed and is thereupon decelerated to such standard speed during the first interval of advancement so that the knives sever a section whose length again matches the desired length. If a first web is to be followed by a second web, the leader of the second web is maintained at a standstill at the severing-station, and the second web is accelerated first above the standard speed and is thereupon decelerated to standard speed during an interval following stoppage or expiration of the first web so that the length of the first separated section of the second web again matches the desired length.

9 Claims, 4 Drawing Sheets

METHOD OF SUBDIVIDING WEBS

BACKGROUND OF THE INVENTION

The invention relates to improvements in methods of and in apparatus for subdividing webs or strips of paper, metallic foil, plastic foil or a combination of such or similar materials. More particularly, the invention relates to improvements in methods of and in apparatus for subdividing webs into sections of predetermined length. Still more particularly, the invention relates to improvements in methods of and in apparatus for subdividing running webs of coherent labels and/or blanks of wrapping material into a series of discrete sections having a predetermined length.

It is already known to subdivide a running web into sections of desired length by resorting to an apparatus wherein a conveyor advances the web along a predetermined path and a severing device employing at least one orbiting knife is utilized to sever the running web in a predetermined portion of its path. The web is drawn off a bobbin or another suitable source of supply. Reference may be had, for example, to German Pat. No. 24 35 441 C which discloses an apparatus wherein an orbiting knife cooperates with a counterknife to sever the running web at desired intervals. The separated sections of the web can constitute discrete blanks of wrapping material, and such blanks are transported to a packing machine. The leader of a second web is maintained in a state of readiness at the severing station in order to avoid prolonged interruptions of delivery of blanks to the packing machine when the preceding web has expired. The second web is set in motion in response to expiration of the preceding web. The last blanks which are separated from the expiring web and/or the foremost blanks which are separated from the next-following web normally exhibit defects, or the last blank which was severed from the expiring web is followed by a gap which, in turn, is followed by the first blank severed from the next-following web. This creates numerous problems in that certain objects which are to be wrapped in the packing machine are not wrapped at all and certain other objects are draped into defective blanks so that the finished products must be monitored and the products exhibiting defective wrappers must be segregated from satisfactorily wrapped products. All this contributes to the cost of the ultimate products and reduces the output of the packing machine.

German Pat. No. 12 33 686 discloses an apparatus which renders it possible to place the trailing end of an expiring web end-to-end with the leader of the next-following web without resorting to an adhesive. However, the operation of such apparatus (as well as the operation of apparatus disclosed in German Pat. No. 24 35 441 C) cannot be interrupted if the proper relationship of successively severed sections relative to each other is to be maintained.

On the other hand, it happens again and again that the operation of an apparatus which is to subdivide running webs of paper or other flexible material into individual sections of desired length must be interrupted for any one of a number of reasons. For example, a web which carries a series of labels can exhibit portions which are devoid of labels or carry defective labels. Furthermore, the operation of the apparatus must be interrupted upon completion of a shift or for the purpose of inspecting the severing apparatus and/or the machine or plant which receives severed sections from the severing apparatus.

The interruptions can be very short or they can last for extended periods of time.

Accordingly, there exists an urgent need for methods of and for apparatus for subdividing webs of coherent labels, blanks of wrapping material or the like into sections of predetermined length (e.g., unit length) in such a way that the operation can be interrupted for a desired interval or time and thereupon restarted without the making of unsatisfactory sections and/or without interrupting the delivery of successively severed sections to one or more consuming machines.

OBJECTS OF THE INVENTION

An object of the invention is to provide a method which renders it possible to interrupt the severing of a running web and to resume the severing without affecting the quality of the severed sections.

Another object of the invention is to provide a method which renders it possible to subdivide a web into sections of identical length even if the severing of the web is interrupted for shorter or longer intervals, either once or more than once.

A further object of the invention is to provide a method which renders it possible to follow the subdivision of a preceding web with the subdivision of a next-following web in such a way that neither the dimensions nor the mutual spacing of successively formed sections changes immediately prior as well as subsequent to expiration of the preceding web.

An additional object of the invention is to provide a method which can be used with particular advantage for subdivision of webs into blanks of wrapping material or into discrete labels or the like.

Still another object of the invention is to provide a method which can be resorted to for the application of discrete labels to containers for beverages, cans or other types of receptacles in bottle filling and like machines.

A further object of the invention is to provide a method which renders it possible to reliably guide a web all the way to the severing station as well as to reliably guide successively obtained sections of a web away from the severing station.

Another object of the invention is to provide a novel and improved apparatus for the practice of the above outlined method.

An additional object of the invention is to provide the apparatus with novel and improved means for advancing webs to a severing or subdividing station.

Still another object of the invention is to provide the apparatus with novel and improved means for economizing with the material of webs and for enhancing the output of the machine or machines which receive web sections from such apparatus.

A further object of the invention is to provide an apparatus which can properly subdivide successive webs of paper or the like into sections of predetermined length irrespective of the speed of webs along their paths, whose operation can be interrupted as often as necessary during subdivision of a particular web without affecting the quality of subsequently severed sections, and which renders it possible to dispense with splicing mechanisms for attachment of the trailing end of a preceding web to the leader of the next-following web.

Another object of the invention is to provide a method of and an apparatus for subdividing webs into sections of desired length in such a way that one or more sections which were severed from a first web can be followed by one or more sections which were severed from a different second web without affecting the mutual spacing, the dimensions and/or other parameters of the sections.

An additional object of the invention is to provide an apparatus which can be utilized in existing machines or production lines as a superior substitute for heretofore known and used apparatus for subdivision of running webs into sections of selected length.

Still another object of the invention is to provide an apparatus wherein the freshly separated sections cannot interfere with the advancement of the leader of a web behind such sections.

A further object of the invention is to provide the apparatus with novel and improved means for reliably guiding one or more webs on their way toward the severing station.

Another object of the invention is to provide the apparatus with plural advancing means for one or more webs of paper or the like.

An additional object of the invention is to provide a machine or a production line which embodies or cooperates with an apparatus of the above outlined character.

Still another object of the invention is to provide the apparatus with novel and improved means for varying the speed of the webs on their way toward the severing station.

SUMMARY OF THE INVENTION

One feature of the present invention resides in the provision of a method of subdividing an elongated (first) web into sections of predetermined length, for example, for subdividing a web of coherent indicia-bearing labels into discrete labels. The method comprises the steps of advancing the web in a predetermined direction at a first speed along a predetermined path, repeatedly severing the web with at least one orbiting knife in a predetermined portion of the path upon elapse of each of a series of successive intervals of advancement of the web along the path to separate a succession of sections from the web, accelerating the web above the first speed during a first portion of one of the intervals, and decelerating the web to zero speed during a second portion of the one interval.

The severing step can include severing the web in the predetermined portion of the path upon elapse of the one interval, i.e., while the speed of the web is zero.

The accelerating step can include raising the speed of the web from the first speed to a predetermined overspeed.

The method preferably further comprises the step of regulating the accelerating and decelerating steps to advance a web section of predetermined length beyond the predetermined portion of the path not later than when the web is decelerated to zero speed.

The method can further comprise the steps of advancing a leader of a second web to the predetermined portion of the predetermined path while the elongated (first) web is being advanced along the predetermined path and arresting the second web when its leader is at least close to the predetermined portion of the predetermined path. The severing step of such method includes severing the elongated web in the predetermined portion of the predetermined path upon elapse of the one interval while the speed of the elongated web is zero, and this method further comprises the steps of accelerating the arrested second web to an overspeed or further speed exceeding the first speed during a first portion of an additional or further interval following the one interval to thus advance the leader of the second web in the predetermined direction along the predetermined path beyond the predetermined portion of the predetermined path, and thereupon reducing the speed of the second web from overspeed or further speed to the first speed during a second portion of the additional interval.

The method preferably further comprises the step of removing separated sections from the predetermined portion of the predetermined path, including advancing successive separated sections at a speed which exceeds the first speed.

The severing step can include orbiting the at least one knife at a predetermined speed, and such method can further comprise the step of continuing the orbiting of the at least one knife at such predetermined speed upon completion of the decelerating step, i.e., while the speed of the elongated web is zero.

The method can further comprise the steps of accelerating the elongated web from zero speed to an overspeed exceeding the first speed during a first portion of a further interval following the one interval, and decelerating the elongated web from such overspeed to the first speed during a second portion of the further interval. The step of accelerating the elongated web from zero speed can include raising the speed of the web to a predetermined overspeed. Such method preferably further comprises the steps of regulating or adjusting the steps of accelerating the elongated web from zero speed to overspeed and decelerating the web from overspeed to first speed so as to advance a web section of predetermined length beyond the predetermined portion of the predetermined path during the further interval.

Another feature of the invention resides in the provision of an apparatus for subdividing an elongated web (e.g., a web of coherent labels) into sections of predetermined length (e.g., into discrete labels). The improved apparatus comprises an adjustable conveyor system including means for advancing the web in a predetermined direction along a predetermined path at a plurality of speeds including a first speed, an overspeed and zero speed, means for repeatedly severing the web in a predetermined portion of the path to separate from the web a succession of sections of predetermined length and including at least one orbiting knife which serves to sever the web upon elapse of each of a series of successive intervals of advancement of the web along the path, and means for adjusting the advancing means to accelerate the web to the overspeed during a first portion of one of the intervals and to thereupon decelerate the web to zero speed during a second portion of the one interval.

The adjusting means preferably comprises means for regulating the acceleration and deceleration of the web during the one interval in such a way that a web section of predetermined length is located downstream of the predetermined portion of the path after elapse of the one interval. The severing means can comprise means for causing the at least one knife to sever the web upon elapse of the one interval and to thus separate the aforementioned web section of predetermined length from the web in the path.

The advancing means can include means for advancing the web at a predetermined overspeed and for decelerating the web at a rate such that a web section of predetermined length is located downstream of the predetermined portion of the path upon elapse of the one interval and when the web is already decelerated to zero speed. The same result can be achieved if the adjusting means includes means for adjusting the advancing means to a predetermined overspeed and to a predetermined rate of deceleration of the web in such a way that a web section of predetermined length is located downstream of the predetermined portion of the path upon elapse of the one interval and when the web is already decelerated to zero speed.

The advancing means can comprise driven rolls which define for the web a nip in a second portion of the path, normally upstream of the predetermined portion of such path. At least one of the rolls is preferably provided with a web-engaging rim of elastomeric material (e.g., rubber or an elastomeric plastic material). If the second portion of the path is located upstream of the predetermined portion, the advancing means can further comprise a pneumatic conveyor between the two portions of the path. The pneumatic conveyor preferably comprises at least one endless foraminous conveyor belt and a suction chamber adjacent the belt. The advancing means of such apparatus can further comprise means for driving the rolls at peripheral speeds corresponding to the aforementioned plurality of speeds, and means for driving the pneumatic conveyor at a speed exceeding the peripheral speeds of the rolls.

The adjusting means can further comprise means for adjusting the advancing means to accelerate the web from zero speed to a further speed exceeding the first speed during a first portion of a further interval following the one interval and to thereupon decelerate the web from the further speed to the first speed during a second portion of such further interval. The advancing means can include means for accelerating the web from zero speed to a predetermined further speed and for thereupon decelerating the web to the first speed at a rate which is selected in such a way that a web section of predetermined length is located downstream of the predetermined portion of the path upon elapse of the further interval. The same result can be achieved if the adjusting means includes means for adjusting the advancing means to a predetermined further speed and to a predetermined rate of deceleration of the web from the predetermined further speed to the first speed such that a web section of predetermined length is located downstream of the predetermined portion of the path upon elapse of the further interval and when the speed of the web matches the first speed.

The apparatus can further comprise a second adjustable conveyor system including second means for advancing a second web in a second direction along a second path which merges into the predetermined path at the predetermined portion of the predetermined path. The adjusting means of such apparatus preferably includes means for adjusting the second advancing means independently of the means for advancing the elongated (first) web. The adjusting means can comprise means for accelerating the second web from zero speed to a further speed exceeding the first speed during a first portion of a further interval which follows the one interval and for thereupon decelerating the second web from the first speed to the first speed during a second portion of the further interval.

If the webs are provided with spaced-apart machine-detectable indicia (e.g., one indicium for each label of a web of coherent labels), and the apparatus further comprises means for orbiting the at least one knife at least at one preselected speed. The adjusting means of such apparatus can comprise signal generating means for monitoring the speed of the at least one knife, signal generating means for monitoring the paths for the presence of indicia on the respective webs, and means for processing the signals from the monitoring means and for utilizing the processed signals to adjust the advancing means. Such adjusting means can further comprise signal generating means for monitoring the speeds of the advancing means for the two webs and for transmitting corresponding signals to the processing means.

An apparatus with two advancing means can further comprise a guide which is disposed between the two paths upstream of the predetermined portion of the predetermined path. The guide has a first surface (e.g., a plane surface) adjacent the predetermined path and a second surface (e.g., a plane surface) adjacent the second path. The two surfaces make an acute angle. Such apparatus can further comprise at least one nozzle which is disposed between the surfaces of the guide and has means for discharging a compressed gaseous fluid (e.g., air) toward the predetermined portion of the predetermined path. The discharging means can include at least one elongated orifice, and the surfaces of the guide can be disposed in mutually inclined planes which cross each other along the elongated orifice.

The apparatus can further comprise means for transporting successively separated sections of predetermined length along the predetermined path beyond the predetermined portion of such path and preferably at a speed exceeding the first speed.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
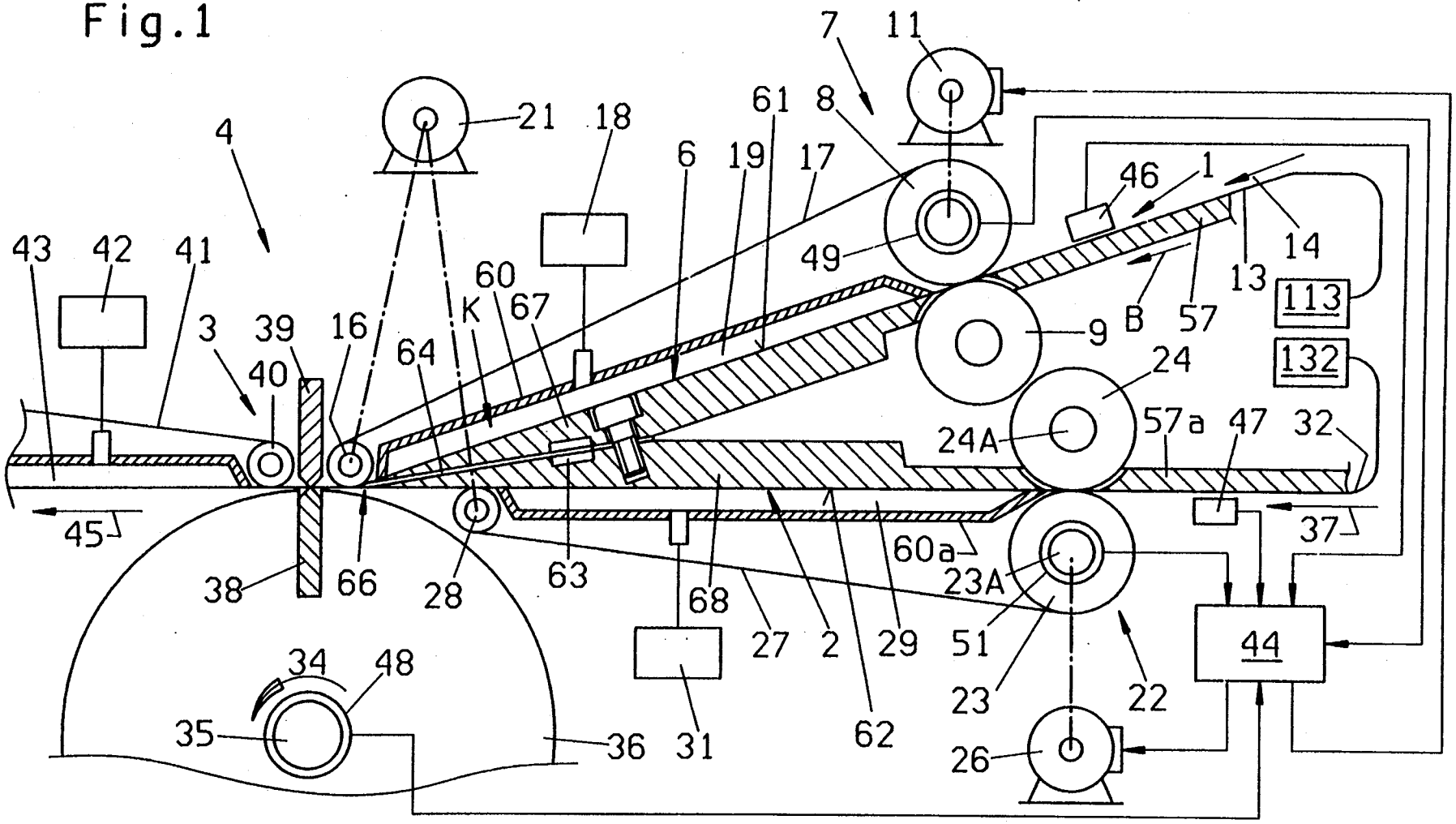
FIG. 1 is a fragmentary partly schematic and partly vertical sectional view of an apparatus which embodies one form of the invention.
Figure 2:
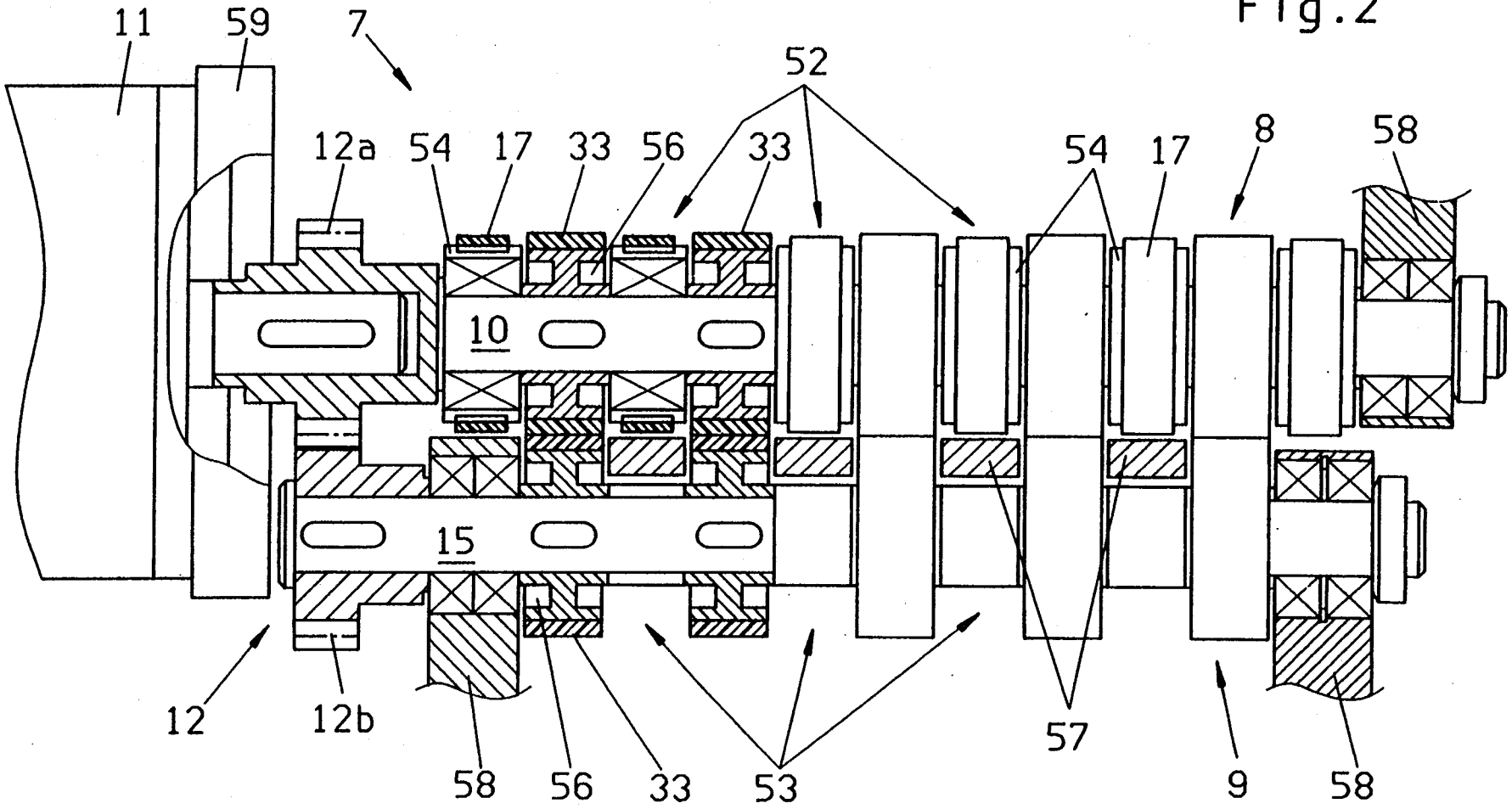
FIG. 2 is an enlarged view of the advancing means for an elongated web substantially as seen in the direction of arrow B in FIG. 1.
Figure 5:
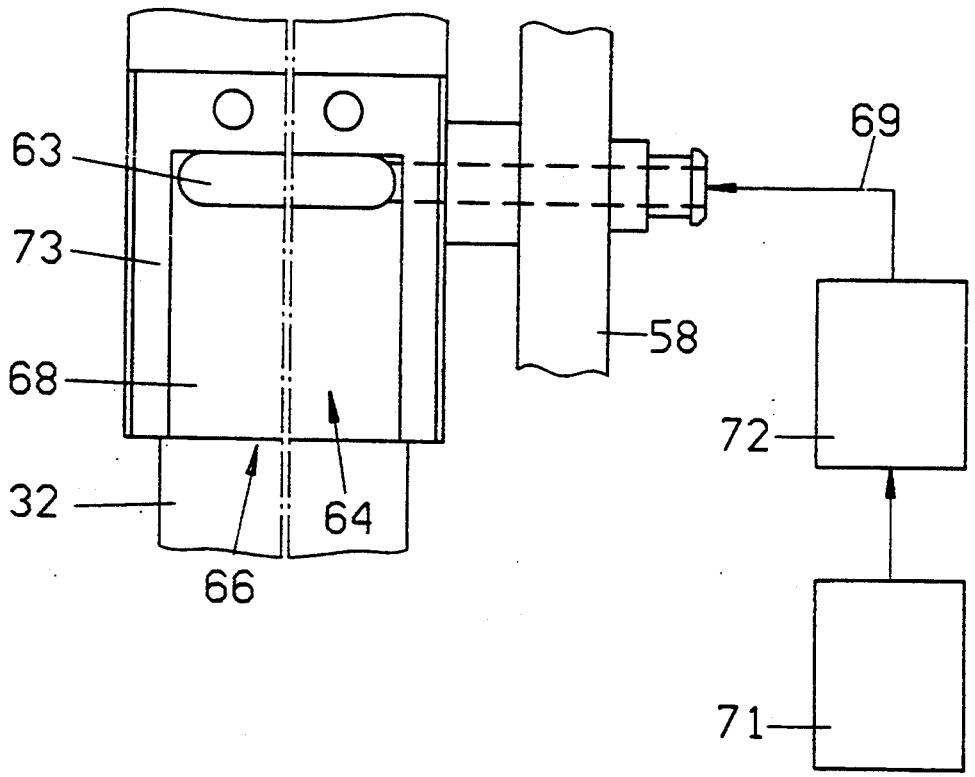
FIG. 5 is a fragmentary schematic view of a region immediately upstream of the predetermined portion of the predetermined path, substantially as seen in the direction of arrow K in FIG. 1.

FIGS. 1, 2 and 5 show those parts of an apparatus embodying the invention which are necessary for full understanding of the improvements. The apparatus defines a first (predetermined) path 1 for a first web 13 (e.g., a web of coherent labels), and a second path 2 for a second web 32 (e.g., a web of coherent labels). The second path 2 merges into a predetermined portion 3

(severing station) of the first path 1, and the webs 13 and 32 are respectively advanced in directions which are indicated by arrows 14 and 37. The means 4 for repeatedly severing the web 13 or 32 at the station 3 comprises a knife 38 which is mounted in and is orbited by a rotary holder 36, and a stationary second knife or counterknife 39 which is installed opposite the orbiting knife 38 and cooperates with the latter to sever the web 13 or 32 once during each revolution of the holder 36. The paths 1 and 2 converge toward each other at an acute angle at opposite sides of a wedge-like guide 6 whose tip points toward the severing station 3.

An adjustable conveyor 7 for transporting the web 13 in the direction of arrow 14 along a plane surface 61 of the guide 6 comprises at least two parallel advancing rolls 8, 9, a variable-speed electric motor 11 which drives the shaft 10 (FIG. 2 of the roll or rolls 8, and a gear transmission 12 (FIG. 2) which transmits torque from the shaft 10 to the shaft 15 for the roll or rolls 9 so that the rolls 8, 9 are driven in synchronism. The peripheral surfaces of each pair of rolls 8 and 9 define a relatively wide nip for the web 13 which is drawn from a suitable source 113 (e.g., a bobbin) and is provided with suitable indicia or markers, e.g., one for each of the series of labels assumed to form part of or to constitute the web 13.

The transmission 12 which transmits torque from the shaft 10 to the shaft 15 comprises a first gear **12*a* which is coaxial with the shaft 10 for the roll or rolls 8 and a second gear 12*b* which is in mesh with the gear 12*a* and is affixed to the shaft 15 for the roll or rolls 9**.

The apparatus further comprises a pneumatic conveyor which is installed between the advancing roll or rolls 8 and the severing station 3 to attract and advance the web 13 while the rolls 8, 9 draw successive increments of such web from the source 113. The pneumatic conveyor comprises one but preferably two or even more endless foraminous belts 17 each trained over a relatively small pulley 16 at the severing station 3 (namely at the stationary counterknife 39) and over a larger idler pulley 54 rotatably mounted on the shaft 10. The pulley or pulleys 16 are driven (at a variable or constant speed) by an electric motor 21. The pneumatic conveyor further comprises a suction generating device 18 (e.g., a fan) and a suction chamber 19 between an inner reach of each foraminous belt 17 (such inner reach or reaches are adjacent the plane surface 61 of the guide 6) and a shroud 60 connected with one end of a conduit which is further connected to the suction intake of the device 18.

A second adjustable conveyor 22 is provided to advance the web 32 from the source 132 (e.g., a bobbin) in the direction of arrow 37 along the plane surface or underside 62 of the wedge-shaped guide 6. The conveyor 22 comprises at least one pair of advancing rolls 23, 24, an electric motor 26 which serves to drive the roll or rolls 23, and a transmission (not shown but corresponding, for example, to the transmission 12) which serves to drive the roll or rolls 24 in synchronism with the roll or rolls 23.

The means for conveying the web 32 along the path 2 and initially to a position in which the leader of the web 32 is located at the severing station 3 further comprises a second pneumatic conveyor including one or more endless foraminous belts 27, one or more relatively small pulleys 28 at the severing station 3 for the belt or belts 27, and one or more coaxial idler pulleys (not shown) corresponding to the pulleys 54 for the belts 17), a suction generating device 31 and a suction chamber 29 adjacent the inner side of the upper reach or reaches of the belt or belts 27 and serving to attract the web 32 opposite the plane surface 62 of the guide 6. The pulley or pulleys 28 for the endless foraminous belt or belts 27 is or are driven by the motor 21. Of course, it is also possible to provide a discrete motor 21 for each of the pulleys 16 and 28. A shroud **60*a* is installed between the two reaches of the belt or belts 27 to bound a portion of the suction chamber 29**.

The advancing rolls 8, 9 and 23, 24 are preferably provided with rims 33 of elastomeric material (such rims can be seen on the rolls 8 and 9 of the conveyor 7 shown in FIG. 2), and each roll 8, 24 is biased against the adjacent roll 9, 24 (and/or vice versa) by one or more springs (not specifically shown) to at least slightly flatten the neighboring rims 33 and to thus increase the area of contact between the rolls 8, 9 and the corresponding web 13 as well as between the rolls 23, 24 and the corresponding web 32. Thus, the webs 13 and 32 are in reasonably pronounced surface-to-surface (rather than linear) contact with the respective pairs of advancing rolls 8, 9 and 23, 24. This is desirable because the conveyors 7 and 22 are capable of more predictably transporting the webs 13, 32 along the respective paths 1 and 2 as well as because this reduces the likelihood of curling or similar deformation of the webs as a result of intimate contact with the respective pairs of advancing rolls.

It is presently preferred to employ small-diameter advancing rolls 8, 9 and 23, 24 because the inertia of such relatively small rolls is less pronounced which, in turn, is desirable for rapid and predictable acceleration of the webs 13, 32 to a first or operating speed $v_B$ (FIGS. 3 and 4) or a further speed or overspeed $v_M$ as well as for rapid and predictable deceleration from overspeed $v_M$ to first speed $v_B$ and from first speed $v_B$ to zero speed.

The provision of elastic rims 33 on all of the rolls 8, 9 and 23, 24 is preferred over the utilization of presently employed combinations of steel rolls with rolls having elastomeric rims because the frictional engagement between a web 13 or 32 and a pair of elastic rims 33 is more satisfactory.

The means for driving the holder 36 to thereby orbit the knife 38 about a fixed axis at the underside of the predetermined portion (station 3) of the path 1 comprises a motor-driven or otherwise rotated shaft 35 which is driven in the direction of arrow 34, e.g., at a constant speed so that the cutting edge of the orbiting knife 38 meets the cutting edge of the stationary counterknife 39 at regular intervals during which a web section of predetermined length advances beyond the station 3 and is ready to be severed from the leader of the respective web 13 or 32. The cutting edges of the knives 38 and 39 can extend at right angles to the plane of FIG. 1. It is clear that the holder 36 can carry two or more equidistant orbiting knives 38 which may be advisable if the designer of the apparatus desires to rotate the shaft 35 at a relatively low speed. The cutting edge of the stationary counterknife 39 then cooperates with the cutting edges of successive orbiting knives 38.

When the improved apparatus is in use, e.g., to form a series of discrete labels which are obtained by repeatedly severing the leader of the web 13 at the station 3, the distance between successive cuts across the web 13 (as seen in the direction of the arrow 14) is determined by the length of intervals T (FIGS. 3 and 4) which elapse between successive advancements of the cutting edge of the knife 38 past the cutting edge of the knife 39. The length (duration) of such intervals depends upon the speed of the web 13 (as determined by the adjustable conveyor 7) and by the speed of orbital movement of the knife 38 in the direction of arrow 34.

The knives 38, 39 can be hardened or they can be made of a long-lasting wear-resistant material to thus avoid frequent replacements and to permit the apparatus to operate without interruptions for long periods of time. The shaft 35 is preferably driven without interruptions, i.e., even if the conveyor 7 or 22 is arrested so that the respective web 13 or 32 is brought to a full stop. This renders it desirable to employ a large-diameter knife holder 36 and to install the knife 38 in such a way that its cutting edge projects only slightly radially outwardly beyond the peripheral surface of the holder. An advantage of such combination of holder 36 and knife 38 is that the web (13 or 32) which is being advanced along the respective path is engaged and pulled by the peripheral surface of the large-diameter holder 36 immediately upstream of the station 3, and that the freshly severed web sections are engaged and pushed away from the leader of the remainder of the respective web 13 or 32 by the peripheral surface of the holder 36 immediately downstream of the station 3.

Successively obtained sections of the web 13 or 32 are transported away by a removing conveyor including at least one endless foraminous belt 41 trained over pulleys 40 (only one shown) at least one of which is driven to advance the lower reach of the belt 41 in the direction of arrow 45, a suction generating device 42 and a suction chamber 43 connected to the device 42 and overlying the inner side of the lower reach of the belt or belts 41. The at least one pulley 40 is preferably driven at a speed to ensure that the speed of freshly formed web sections immediately exceeds the speed of the leader of the remainder of the web 13 or 32 so that the freshly formed web sections cannot interfere with predictable advancement of the leader of the web 13 or 32 toward the station 3. The conveyor including the belt or belts 41 can transport the freshly formed web sections (e.g., discrete labels) to a container filling machine, not shown. Alternatively, the conveyor including the belt or belts 41 can be used to deliver successive blanks of wrapping material to one or more packing machines, not shown.

If desired, the discrete suction generating devices 18, 31 and 42 can be replaced with a single suction generating device. Alternatively, the suction generating device 42 can be retained and the devices 18, 31 can be replaced with a single suction generating device which is connected to the chambers 19 and 29.

The means for adjusting the motors 11 and 26 (i.e., for selecting the speeds of the conveyors 7, 22 and hence the speeds of the webs 13 and 32) comprises a signal processing circuit 44 and a plurality of monitoring devices including detectors 46, 47 respectively adjacent the paths 1, 2 and serving to generate signals in response to detection of successive indicia on the webs 13 and 32. The monitoring devices further include tachometer generators 48, 49 and 51 which respectively generate signals denoting the speed of orbital movement and/or the angular position of the knife 38, the speed of the shaft 10 and advancing rolls 8, 9, and the speed of the shaft 25 of the advancing roll or rolls 23 and hence the speed of the roll or rolls 24. The outputs of the monitoring devices 46, 47, 48, 49, 51 are connected to the corresponding inputs of the signal processing circuit 44, and the two outputs of this circuit are connected to the controls for the motors 11 and 26.

FIG. 2 shows that the rolls 8 form a battery of coaxial rolls which are separated from each other by axially and circumferentially extending clearances 52 for the pulleys 54. As already explained above, each pulley 54 is an idler pulley and is surrounded by one of the endless foraminous belts 17. The rolls 9 are separated from each other by uniformly distributed clearances 53 of preferably identical width (as measured in the axial direction of the shaft 15). The manner of mounting the rolls 23, 24 on their respective shafts 23A, 24A is preferably the same as described above for the rolls 8 and 9 and as shown for the rolls 8 and 9 in FIG. 2. The same applies for the mounting of idler pulleys for the foraminous belt or belts 27; such idler pulleys are mounted on the shaft 23A and cooperate with the pulley or pulleys 28 to maintain the belt or belts 27 under requisite tension and to drive the upper reach or reaches of such belt or belts in the direction of arrow 37, preferably at a speed greater than the peripheral speed of the rolls 23 and 24.

It is often preferred to employ two or more endless foraminous belts 17 and/or two or more endless foraminous belts 27; this ensures more predictable and reproducible advancement of the web 13 and/or 32 to the severing station 3.

FIG. 2 further shows that the advancing rolls 8 and 9 are provided with suitably distributed recesses 56 in the form of blind bores or holes, notches or the like. This reduces the inertia of the rolls 8, 9 and enables the conveyor 7 to more rapidly respond to signals from the corresponding output of the signal processing circuit 44 to the controls for the motor 11. Analogous recesses can be provided in the advancing rolls 23, 24 of the conveyor 22 for the web 32. The diameters of the rolls 8, 9 and 23, 24 are preferably small, again for the purpose of reducing their masses and of ensuring more accurate advancement of the web 13 or 32 along the respective path to the severing station 3.

The upper half of the wedge-shaped guide 6 has rearwardly projecting extensions or prongs 57 (FIGS. 1 and 2) which extend through the grooves 53 between neighboring rolls 9 to ensure accurate guidance of the web 13 upstream of the nip of the rolls 8, 9. As can be seen in FIG. 1, the extensions 57 guide the web 13 during advancement past the monitoring device 46. The extensions 57 can guide the web 13 all the way to the source 113. Similar extensions **57*a* are provided in the gaps between the rolls 23 of the conveyor 22 upstream of the rolls 23, 24, e.g., along the monitoring device 47 and, if necessary, all the way to the source 132**.

The advancing rolls 8, 9 and 23, 24 of the conveyors 7 and 22 are mounted in part in the frame 58 of the improved apparatus and in part in a flange 59 for the motor 11.

The mode of operation of the improved apparatus will be described with reference to FIGS. 1 and 2 as well as with continuous reference to FIGS. 3 and 4. The characters $T_1$ and $T_2$ denote in FIG. 3 the last two intervals of operation of the conveyor 7 prior to stoppage in response to a signal from the processing circuit 44 or from another source of stop signals, namely the two intervals which elapse during the last two orbital movements of the knife 38 prior to stoppage of the conveyor 7 but not of the shaft 35 which continues to drive the knife holder 36. The speed v of the web 13 is measured in FIG. 3 along the ordinate, and the time t (the duration of intervals including those shown at $T_1$ and $T_2$ as well as the preceding intervals of a short or long series of identical intervals) is measured along the abscissa. The curve L denotes the actual length of a web section which has advanced beyond the severing station 3 (i.e., beyond the cutting edge of the stationary counterknife 39) during the respective interval.

The curve Q (highlighted by spaced-apart characters x) denotes the actual variations of speed of the web 13 during the intervals $T_1$ and $T_2$. The speed $v_B$ is the first or operating speed of the conveyor 7, and the speed $v_M$ is the overspeed exceeding the speed $v_B$. As can be seen in FIG. 3, the web 13 is advanced at the first speed $v_B$ during the interval $T_1$, and this ensures that the length of the web section $L_1$ which is severed from the leader of the web 13 at the instant between the intervals $T_1$ and $T_2$ matches the predetermined length. Such predetermined length corresponds to the length of the curve L between the zero point 0 of the coordinate system and the line $L_{B(1)}$; this line crosses the vertical line 3' denoting the plane of the cutting edge of the stationary counterknife 39. The cutting edge of the orbiting knife 38 is located in the plane 3' when the interval $T_1$ has elapsed, i.e., the web section of predetermined length (between 0 and $L_{B(1)}$ is then separated from the remainder of the web 13.

The web 13 is to be brought to a full halt during the interval $T_2$, i.e., the speed of the web 13 should be reduced to zero not later than when the interval $T_2$ elapses. This is not accomplished by simply decelerating the conveyor 7 from the first speed $v_B$ to zero speed but rather by first accelerating the conveyor 7 (and hence the web 13) to the overspeed $v_M$ and by thereupon decelerating the web 13 from the overspeed $v_M$ to zero speed. For example, the conveyor 7 should be brought to a halt because the container filling machine which receives web sections (labels) of predetermined length from the belt or belts 41 has been brought to a halt or has run out of containers to be labelled. Alternatively, the conveyor 7 will be brought to a halt because the web 13 is about to expire and its last section or one of its last sections should be followed by a first or foremost section of the web 32. Still further, the conveyor 7 will be brought to a halt if the next series of containers in the container filling and labelling machine is to receive different labels such as those which can be obtained by repeatedly severing the web 32. Moreover, the conveyor 7 can be brought to a halt due to failure of the motor 11 and/or the pneumatic conveyor including the foraminous belt 17 and/or for another reason.

The signal processing circuit 44 then controls the operation of the motor 11 in the aforedescribed manner, namely that the web 13 is rapidly accelerated from the first speed $v_B$ to the overspeed $v_M$ and is thereupon rapidly decelerated from overspeed $v_M$ to zero speed not later than upon elapse of the interval $T_2$. The acceleration from first speed $v_B$ to overspeed $v_M$ can take up exactly one-half (the first half) of the interval $T_2$, and the deceleration from overspeed $v_M$ to zero speed can also take up exactly one-half (the second half) of the interval $T_2$. However, such exact division of the interval $T_2$ into two equal shorter intervals of acceleration and deceleration, respectively, is not of consequence, as long as the signal processing circuit 44 ensures that the length of the web section $L_2$ which has advanced beyond the plane 3' when the interval $T_2$ has elapsed matches the length of the preceding web section $L_1$ which was severed from the web 13 in the plane 3' after elapse of the interval $T_1$.

Figure 3:
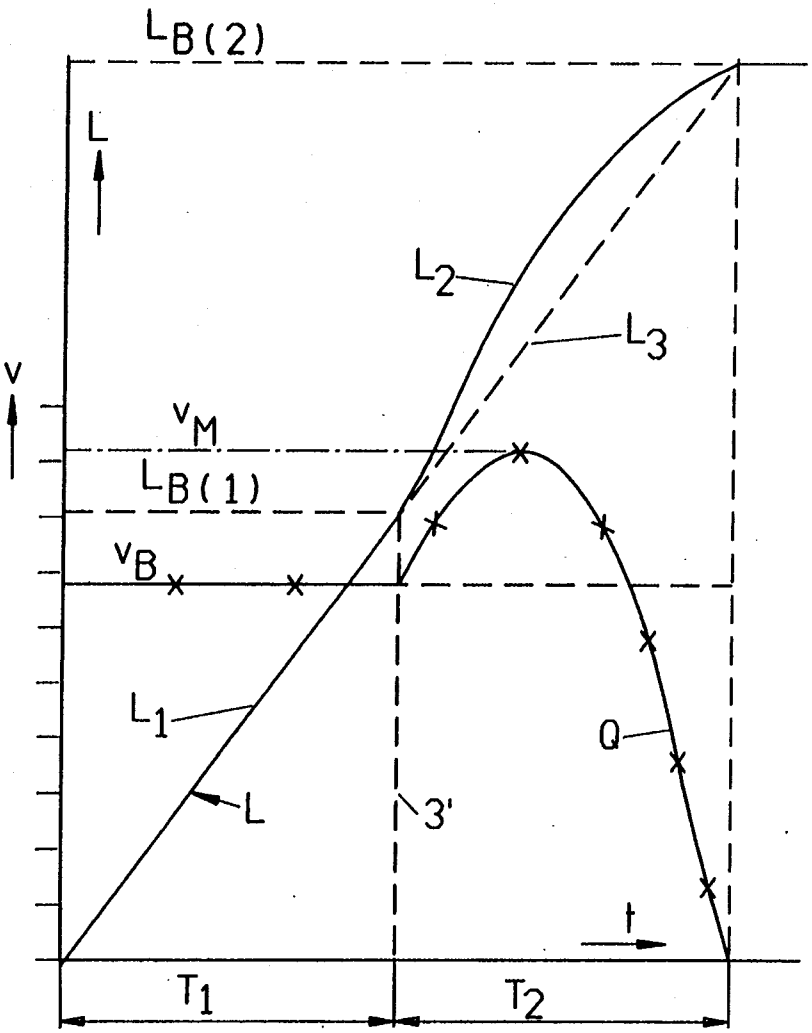
FIG. 3 is a diagram of speeds, times and distances covered by the leader of a web prior to stoppage.

If the deceleration of the web 13 were to begin immediately after elapse of the interval $T_1$, i.e., without initial acceleration from first speed $v_B$ to the overspeed $v_M$, the length of the last web section would be less than the length of the immediately preceding web section (between the zero point 0 and the line $L_{B(1)}$ in the diaphragm of FIG. 3). This will be readily appreciated by bearing in mind that, if the speed of the web 13 were to decrease from the first speed $v_B$ to zero speed during the entire interval $T_2$, the length of the last web section prior to stoppage of the conveyor 7 would have to be shorter than the length of the immediately preceding web section (which was advanced past the cutting edge of the stationary counterknife 39 (i.e., beyond the plane 3' in FIG. 3) during the interval $T_1$. Therefore, the shorter web section would have to be treated as a reject and would have to be segregated from satisfactory web sections, either in the improved apparatus or in the next-following machine, apparatus or production line, e.g., a labelling machine or a packing machine.

The overspeed $v_M$ and the timing of the start of deceleration from such overspeed to zero speed as well as the rate of acceleration from first speed $v_B$ to overspeed $v_M$ as well as the rate of deceleration from overspeed to zero speed can be readily selected with a view to ensure that the length of the last web section $L_2$ prior to stoppage of the conveyor 7 will exactly match a predetermined length, i.e., the length of each preceding satisfactory web section $L_1$. The length of the next-to-the-last web section $L_1$ (which was separated from the web 13 after elapse of the interval $T_1$) matches the length of the last web section $L_2$ which is separated by the continuously orbiting knife 38 in cooperation with the counterknife 39 after elapse of the last interval $T_2$ preceding stoppage of the conveyor 7. The broken line $L_3$ is intended to done the length of the last web section if the conveyor 7 were not accelerated to the overspeed $v_M$ during a first portion of the interval $T_2$.

The line $L_{B(2)}$ denotes in FIG. 3 the length of the last web section between the lines $L_{B(1)}$ and $L_{B(2)}$. The two last web sections have identical lengths in spite of the fact that the speed of the conveyor 7 was changed from first speed $v_B$ during the last interval $T_2$ prior to stoppage of the web 13.

Figure 4:
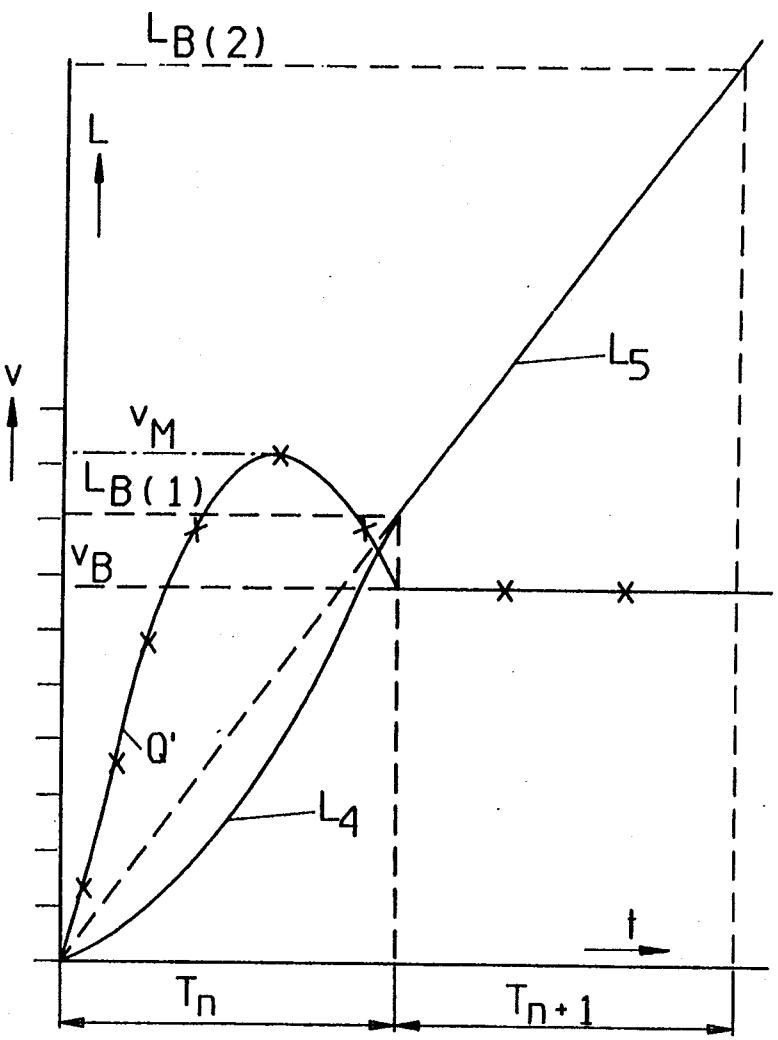
FIG. 4 is a similar diagram of times, distances and speeds immediately after starting or restarting of a web.

FIG. 4 illustrates the speed of the web 13 (or the speed of the web 32) during the first two intervals of operation following stoppage of the web 13, depending upon whether the web section which was obtained as a result of severing of the web after elapse of the interval $T_2$ is to be followed by additional sections of the web 13 or by the first, second, etc. sections of the web 32. It is assumed that the web 13 is to be restarted with a predetermined or any other shorter or longer delay following elapse of the interval $T_2$. The knife 38 continues to orbit and the web 13 is restarted when the cutting edge of the orbiting knife 38 registers with the cutting edge of the counterknife 39. If the web 13 has expired or the apparatus is to sever the web 32 for any other reason, the leader of the web 32 is moved into the plane of the cutting edge of the counterknife 39 before the interval $T_n$ begins, and the motor 26 is caused to start the rolls 23, 24 when the cutting edge of the knife 38 is in register with the cutting edge of the knife 39. If the supply of web 13 was exhausted after elapse of the interval $T_2$, the source 113 is replenished while the source 132 supplies the web 32 to be subdivided at the station 3.

The curve Q' in the diagram of FIG. 4 again indicates the exact or actual progress of the speed of the web 13 or 32 during the first two intervals $T_n$ and $T_{n+1}$ following stoppage of the motor 11 and web 13. If the web 13 is to be restarted (while the leader of the web 32 is preferably already located at the plane of the cutting edge of the knife 39), the signal processing circuit 44 causes the conveyor 7 to immediately accelerate the web 13 to and beyond the first speed $v_B$, i.e., all the way to a further speed $v_M$ which may but need not match the speed $v_M$ in the diagram of FIG. 3, and the web 13 is thereupon decelerated from further speed $v_M$ to first speed $v_B$ not later than at the instant of elapse of the interval $T_n$. Again the rate of acceleration to $v_M$ and subsequent deceleration from $v_M$ to $v_B$, as well as the duration of acceleration to $v_M$ and the duration of deceleration from $v_M$ to $v_B$ are selected in such a way that the length $L_4$ of the web section which is severed from the web 13 upon elapse of the interval $T_n$ matches the prescribed or optimum length, preferably the length $L_1$ or $L_2$.

During the next-following interval $T_{n+1}$, the web 13 is again advanced at the first speed $v_M$ to thus ensure that the length of the web section $L_5$ which is separated from the web 13 by the knives 38, 39 after elapse of the interval $T_{n+1}$ will match that of the web section $L_4$ or $L_2$ or $L_1$. The speed of the web 13 remains at $v_B$ during the intervals $T_{n+2}$ (not shown) and so on, until the motor 11 is arrested again or the supply of the web 13 is exhausted.

It will be seen that the method of restarting the web 13 or of starting the web 32 involves the same steps as the method of decelerating the web 13 or any other web and that even the sequence of steps is the same, i.e., acceleration to the overspeed $v_M$ precedes a deceleration of the web. However, whereas the steps which were described with reference to FIG. 3 involve acceleration from first speed $v_B$ to overspeed $v_M$ and subsequent deceleration to zero speed, the steps which were described with reference to FIG. 4 involve acceleration from zero speed to overspeed $v_M$ and subsequent deceleration from overspeed $v_M$ to first speed $V_B$.

An advantage of the aforedescribed method and apparatus is that the number of rejects is drastically reduced, not only because a preceding web (such as 13) can be subdivided into a maximum number of sections of desired length but also because even the first or foremost section which is severed from the next-following web (such as 32) invariably exhibits an optimum (predetermined) length.

The signal processing circuit 44 can be further provided with an additional output (not shown) which transmits signals to the motor for the shaft 35 carrying the orbiting knife 38, i.e., the means for adjusting the conveyors 7 and 22 can also serve to adjust the speed of orbital movement of the knife 38. The signals from the aforediscussed monitoring means 46, 47, 48, 49 and 51 can be readily processed in such a way that the circuit 44 controls the motors 11 and 26 in a manner as described with reference to FIGS. 3 and 4.

As already explained above, the speed of the foraminous conveyor belts 17 and 27 preferably exceeds the peripheral speeds of the advancing rolls 8, 9 and 23, 24, respectively, and the speed of web sections which are attracted to the removing belt or belts 41 preferably exceeds the speed of advancement of the web 13 or 32 toward and beyond the severing station 3. This ensures that a freshly separated web section is immediately accelerated and moved away from the adjacent leader of the remaining portion of the web 13 or 32.

The improved apparatus is preferably further provided with means for facilitating proper positioning of the leader of the web 32 at the plane for the cutting edge of the stationary counterknife 39 while the web 13 is being subdivided into sections of desired length. Such facilitating means is further designed to prevent the leader of the web 32 from interfering with advancement of the web 13 along the path 1. As can be seen in FIGS. 1 and 5, the facilitating means comprises at least one nozzle 64 which is disposed between the two substantially plate-like parts 67, 68 of the wedge-shaped guide 6 and has at least one orifice 66 (such as an elongated slit-shaped orifice extending at right angles to the plane of FIG. 1) which discharges a stream of compressed gaseous fluid (such as air) toward the station 3 at a locus where the planes of the surfaces 61, 62 on the parts 67, 68 of the guide 6 cross each other. The stream of compressed gaseous fluid is discharged between the underside of the web 13 and the upper side of the leader of the web 32.

The orifice 66 of the nozzle 64 receives compressed gaseous fluid from a channel 63 which is defined by the wedge-like front portions of the parts 67, 68 and extends at right angles to the plane of FIG. 1. This can be best seen in FIG. 5 wherein the part 67 of the guide 6 is omitted. The channel 63 receives compressed gaseous fluid through a conduit 69 extending from a source 71 to the guide 6 (through the frame 58) and containing an adjustable fluid flow regulating valve 72. The valve 72 can constitute a simple shutoff valve or it can be designed to vary the rate of flow of compressed gaseous fluid within a selected range from zero flow to a maximum value.

The width of the nozzle 64 (i.e., the length of its orifice 66) at least equals the maximum width of a web 13 or 32, and the width of the orifice 66 is preferably very small to discharge a very thin laminar flow of compressed gaseous fluid. For example, the width of the orifice 66 between the tips of the parts 67, 68 can be in the range of ±0.1 mm. The exact width of this orifice will be selected in dependency on a plurality of parameters including the characteristics of the webs 13, 32, the speed of the running web 13 or 32 and/or others.

In order to form an orifice 66 of accurately selected minimal width, the adjacent surfaces of the parts 67, 68 of the guide 6 can be ground, milled, polished and/or otherwise treated to a precision finish. It has been found that the exact width of the orifice 66 can be selected and maintained in a much simpler way by proceeding as follows: A sealing element 73 (FIG. 5) made of paper or the like and having a selected thickness is placed between the adjacent surfaces of the parts 67, 68. The illustrated sealing element 73 is substantially U-shaped. The two legs of the U-shaped sealing element 73 flank the end portions of the narrow orifice 66 and the web between the two legs of the element 73 is located between the parts 67, 68 behind the channel 63. The thickness of the sealing element 73 determines the width of the orifice 66 as well as the effective length of the nozzle 64.

The nozzle 64 ensures that the apparatus of FIGS. 1, 2 and 5 operates properly while the web 13 is running and the leader of the web 32 is immediately adjacent the plane of the cutting edge of the counterknife 39 or vice versa. The flow of compressed air issuing from the orifice 66 of the nozzle 64 forms a thin cushion between the leader of the web 13 or 32 at the counterknife 39 and the running web 32 or 13. Such cushion acts not unlike a bearing which prevents direct frictional engagement between the two webs and thus further ensures that the web 13 or 32 can be advanced at the exact speed which is determined by signals from the processing circuit 44 to the motor 11 or 26. The valve 72 can be actuated to prevent the flow of compressed gaseous fluid from the source 71 to the channel 63 when the leader of the web 13 or 32 is not held at a standstill adjacent the plane of the cutting edge of the counterknife 39, i.e., the nozzle 64 need be put to use only during shifting from advancement of the web 13 to advancement of the web 32 or the other way around. Otherwise stated, the nozzle 64 is deactivated when the web 13 or 32 is running and the leader of the other web is not maintained close to the counterknife 39.

The single orifice 66 of substantial width can be replaced with a set of narrower orifices, or the single nozzle 64 can be replaced with two or more discrete nozzles without departing from the spirit of the present invention. All that counts is to ensure that the nozzle or nozzles will discharge one or more flows of compressed gaseous fluid which establishes the aforediscussed cushion or cushions and guarantees that the positioning of the leader of the web 13 or 32 into close or immediate proximity to the counterknife 39 does not interfere with optimal advancement of the other web toward, through and beyond the station 3.

The paths 1 and 2 for the webs 13 and 32 are or can be horizontal or nearly horizontal. Thus, FIG. 1 shows a presently preferred positioning and orientation of the paths 1 and 2, namely in such a way that one of these paths overlies the other path.

An important advantage of the improved apparatus is that the number of rejects is reduced to a minimum, i.e., that each of the webs 13, 32 can furnish a maximum number of satisfactory web sections. The reason is that the length of the last web section which is formed prior to stoppage of a web is the same as the length of each preceding (satisfactory) web section, and that the length of the first or foremost web section which is obtained immediately following starting or restarting of the web 13 or 32 is the same as the length of each next-following (satisfactory) web section.

Another important advantage of the improved method and apparatus is that the apparatus can shift from severing of the web 13 to severing of the web 32 (or the other way around) without turning out any unsatisfactory web sections and even without interrupting the advancement of a web (13 or 32) toward, through and beyond the severing station 3.

A further important advantage of the improved method and apparatus is that the quality of web sections is not affected by the selected speed of the web 13 or 32, i.e., the signal processing circuit 44 can be readily designed in such a way that it can perform the aforedescribed functions even when the web 13 or 32 is advanced at a very high speed.

Still another important advantage of the improved method and apparatus is that stoppage of the web 13 or 32 does not entail the making of rejects, either prior to or following such stoppage and irrespective of whether the stoppage is short-lasting or longer. This is important when the apparatus is to deliver web sections to machines or production lines which are designed to turn out large numbers of labelled containers, labelled packages, wrapped objects or any other products which require or must be combined with (e.g., wrapped into) web sections of accurately determined length. Thus, the quality of the web sections is not affected by any stoppage of the apparatus, regardless of the duration of stoppage and regardless of whether the stoppage was caused by a defect of the improved apparatus or was initiated by a defect of the machine or machines which receive web sections from the improved apparatus. Additional savings in the material of the webs are achieved because any stoppage of the apparatus does not affect the quality of web sections, i.e., the apparatus can be stopped whenever necessary to accommodate the machine or production line which receives web sections from the conveyor belt or belts 41. This is in contrast to the operation of all or many conventional apparatus which are preferably maintained in operation even though they turn out web sections which are not needed in a consuming or processing machine because any stoppage of such conventional apparatus would be costlier than the wasting of a certain number of web sections. Thus, the operation of the improved apparatus is more economical than that of heretofore known apparatus.

A further important advantage of the improved method and apparatus is that there is ample time to replenish the supply 113 or 132 without interrupting the operation of the apparatus and that the webs 13, 32 need not be spliced to each other when the supply of the web 13 or 32 is about to be exhausted. Nevertheless, it is possible to operate the apparatus in such a way that the last web section of the web 13 can be immediately followed by the foremost section of the web 13 or vice versa.

An additional important advantage of the improved method and apparatus is that the advancement of the web 13 or 32 can be interrupted at any time, i.e., prior to expiration of the respective web, and that the advancement of the temporarily arrested web can be resumed without risking the making of unsatisfactory web sections. This is of particular advantage if the mode of operation of the machine or machines receiving web sections from the belt or belts 41 is such that labels or other web sections of a first type (e.g., those obtained by severing the web 13) must alternate with labels or web sections of a different second type (e.g., those obtained by severing the web 32).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of subdividing an elongated web into sections of predetermined length, comprising the steps of continuously advancing the web in a predetermined direction at a first speed along a predetermined path; repeatedly severing the continuously advancing web with at least one orbiting knife in a predetermined portion of said path upon elapse of each of a series of successive intervals of continuous advancement of the web along said path to separate a succession of sections from the web; accelerating the web above said first speed during a first portion of a last interval of said successive intervals; decelerating the web to zero speed during a second portion of said last interval; regulating said accelerating and decelerating steps to advance a last web section of said predetermined length beyond said predetermined portion of said path upon expiration of said last interval; and severing the last section from the web while the speed of the web is zero.

2. The method of claim 1, wherein said accelerating step includes raising the speed of the web from said first speed to a predetermined overspeed.

3. The method of claim 1, further comprising the steps of advancing a leader of a second web to said predetermined portion of said predetermined path while the elongated web is being advanced along said predetermined path and arresting the second web, accelerating the arrested second web to an overspeed exceeding said first speed during a first portion of a first interval of advancement of the second web following said last interval to advance the leader in said direction and along said predetermined path beyond said predetermined portion of said path, thereupon reducing said overspeed to said first speed during a second portion of said first interval, and severing a first and a series of additional sections of said predetermined length from the second web while the second web is being advanced at said first speed.

4. The method of claim 1, further comprising the step of removing separated sections from said predetermined portion of said predetermined path, including advancing successive separated sections at a speed higher than said first speed.

5. The method of claim 1, wherein said severing step includes orbiting the at least one knife at a predetermined speed and further comprising the step of orbiting the at least one knife at said predetermined speed upon completion of said decelerating step.

6. The method of claim 1, further comprising the steps of accelerating the web from zero speed to an overspeed higher than said first speed during a first portion of a further interval following said last interval, and decelerating the web from said overspeed to said first speed during a second portion of said further interval.

7. The method of claim 6, wherein said step of accelerating the web from zero speed includes raising the speed of the web to a predetermined overspeed.

8. The method of claim 6, further comprising the step of regulating the steps of accelerating the web from zero speed and decelerating the web from said overspeed to said first speed to advance a web section of predetermined length beyond said predetermined portion of said path during said further interval.

9. The method of claim 1, wherein said sections include labels.

* * * * *